US005572000A

United States Patent [19]

Numata et al.

[11] Patent Number: 5,572,000

[45] Date of Patent: Nov. 5, 1996

[54] DISTRIBUTOR IN IGNITION SYSTEM FOR INTERNAL COMBUSTION ENGINE

[75] Inventors: Yoshimichi Numata, Mito; Hiromitsu Nagae; Michitaka Yumino, both of Katsuta, all of Japan

[73] Assignee: Hitachi, Ltd., Japan

[21] Appl. No.: 194,589

[22] Filed: Feb. 10, 1994

[30] Foreign Application Priority Data

Feb. 10, 1993 [JP] Japan ..... 5-022970

[51] Int. Cl.[6] ..... H01H 19/00

[52] U.S. Cl. ..... 200/19 DR; 200/30 A; 200/31 DP; 200/27 A; 200/19 DC

[58] Field of Search ..... 200/11 R, 19 R, 200/21, 23, 24, 27 R, 27 A, 28, 30 R, 31 DP, 30 A, 19 DC, 19 DR

[56] References Cited

U.S. PATENT DOCUMENTS

| | | | |
|---|---|---|---|
| 3,614,359 | 10/1971 | Beck | 200/166 J |
| 4,039,787 | 8/1977 | Hori et al. | 200/19 R |
| 4,186,286 | 1/1980 | Kuo et al. | 200/19 DR |
| 4,425,485 | 1/1984 | Sone et al. | 200/19 R |
| 5,001,309 | 3/1991 | Hamano | 200/19 DR |
| 5,006,674 | 4/1991 | Ohashi . | |

FOREIGN PATENT DOCUMENTS

| | | | |
|---|---|---|---|
| 0044895A1 | 2/1982 | European Pat. Off. | F02P 7/02 |
| 0045052A2 | 2/1982 | European Pat. Off. | F02P 7/02 |
| 53-90536 | of 1978 | Japan | F02P 7/02 |
| 59-226278 | of 1984 | Japan | F02P 7/02 |
| 61-53461 | of 1986 | Japan | F02P 7/02 |
| 61-76764 | of 1986 | Japan | F02P 7/02 |
| 1450373 | 9/1976 | United Kingdom | H01R 39/02 |
| 2038097 | 7/1980 | United Kingdom | H01T 7/00 |
| 2040579 | 8/1980 | United Kingdom | H01T 7/00 |

*Primary Examiner*—Brian W. Brown
*Assistant Examiner*—Michael A. Friedhofer
*Attorney, Agent, or Firm*—Evenson, McKeown, Edwards & Lenahan P.L.L.C.

[57] ABSTRACT

A distributor for use in an electronic ignition system, in which a rotating electrode is formed of a metallic material, and a dielectric material is provided connected thereto, contacting through a very small area at a portion apart from the sparking surface of the metallic member. The dielectric constant of the dielectric member is larger than that of a rotating body holding the rotating electrode.

37 Claims, 15 Drawing Sheets

DISTRIBUTOR IN IGNITION SYSTEM FOR INTERNAL COMBUSTION ENGINE

BACKGROUND OF THE INVENTION

The present invention relates to a distributor for use in an electronic ignition system for an internal combustion engine such as gasoline engine, and more particularly to a distributor suitable for use in a vehicle engine.

The ignition system of an internal combustion engine, such as a gasoline engine of a vehicle, generates radio frequency noise due to sparking between the spark plug and the distributor. Since the radio noise has a broad frequency band, there is a strong likelihood of resulting interference to various radio communication systems, or a malfunction in various electronic devices mounted on the vehicle.

As shown in FIG. 3, referred to hereinafter, a distributor of the type described above generally has a housing 18 and a camshaft 19 which rotates in fixed relation to the rotation of the internal combustion engine. A distributor rotor arm 12 attached to the top of the camshaft 19 has a rotating electrode 10 on its insulating top surface, and stationary electrodes 16 are provided facing toward a sparking surface 2 in the rotating electrode 10. The plurality of stationary electrodes 16 are positioned along the periphery of the rotation locus of the rotating electrode 10.

A center terminal 14 situated above the rotation center of the rotating electrode 10 is connected to it through a spring 15 and a carbon point 13. The stationary electrodes 16 and the center terminal 14 are contained in a distributor cap 17 mounted the housing 18.

In a distributor having the structure described above, when the rotating electrode 10 comes to a position facing one of the stationary electrodes 16, the high voltage generated by a primary current switching device in the ignition system is conducted through the rotating electrode 10, the center terminal 14, the spring 15 and the carbon point 13. It is then transferred to the stationary electrode 16 by an electric breakdown of the air in a small gap 11 between the sparking surface 2 in the rotating electrode 10 and the stationary electrode 16, to supply a specified spark plug.

The spark between the rotating electrode 10 and the stationary electrode 16 constitutes a source of radio noise. Therefore, such an ignition system has heretofore been provided with various means for suppressing the generation of the radio noise. For example, one method which has widely been used and recognized is to provide a resistor spark plug and a resistor high voltage lead wire.

It has also been proposed to add a dielectric material onto the sparking surface of the rotating electrode in a distributor, which has the effect of lowering the ignition voltage at the start of discharge. For example Japanese Patent Application Laid-Open No. 53-90536 (1978) discloses a method in which a dielectric member is provided projecting on a rotating electrode, and Japanese Patent Application Laid-Open No. 59-226278 (1984) describes a method where silicone varnish is painted on both top and bottom surfaces of a rotating electrode. Japanese Patent Application Laid-Open No. 61-76764 (1986) describes a method in which a dielectric member is adhered closely to a rotating electrode by using a metallic mesh, and in Japanese Patent Application Laid-Open No. 61-53461 (1986) metallic oxide is thermally sprayed onto a rotating electrode.

Each of the above described noise suppression techniques suffers from the same disadvantage: in particular, they make it necessary to increase the sparking voltage, and heat from the spark over a long period of time tends to cause the materials to deteriorate and break down in the area adjacent to the sparking face of the rotating electrode, so that the noise suppression effect is impaired.

SUMMARY OF THE INVENTION

An object of the present invention is to provide a distributor for an electronic ignition system of an internal combustion engine in which the sparking voltage is not increased, and the suppression of radio noise is maintained, even over long periods of time.

This and other objects and advantages are achieved by the distributor according to the invention, in which a rotating electrode (at least the spark point portion thereof facing toward a stationary electrode) is formed of a metallic material, and a dielectric member is provided, contacting the rotating electrode through a very small area at a portion apart from the sparking surface. In this manner the desired noise suppression is achieved, while deterioration of the dielectric element adjacent the sparking surface, such as suffered by the prior art devices, is avoided. The dielectric constant of the dielectric member is larger than that of the rotor holding the rotating electrode.

Other objects, advantages and novel features of the present invention will become apparent from the following detailed description of the invention when considered in conjunction with the accompanying drawings.

BRIEF DESCRIPTION OF THE DRAWINGS

FIG. 1.*b* is a perspective view of the embodiment of FIG. 1.*a;*

FIG. 2.*b* is another sectional view of the prior art rotating electrode of FIG. 2.*a;*

FIG. 2.*c* is a front view of the rotating electrode of FIGS. 2.*a* and 2.*b*, which shows the area in which burning of the elements occurs;

FIG. 4.*b* is a perspective view of the embodiment of FIG. 4*a;*

FIG. 4.*c* is a side view of the embodiment of FIG. 4.*a* and 4.*b;*

FIGS. 4.*d* and 4.*e* are perspective views of alternative arrangements of the dielectric element according to the invention;

FIG. 6.*b* is a perspective view of the embodiment of FIG. 6.*a;*

FIG. 10.*b* is a perspective view of the embodiment of FIG. 10.*a;*

FIG. 10.*c* is a side view of the embodiment of FIG. 10.*a* and 10.*b;*

FIG. 14.*b* is a perspective view of the embodiment of FIG. 14.*a*; and

DETAILED DESCRIPTION OF THE DRAWINGS

Figure 3:
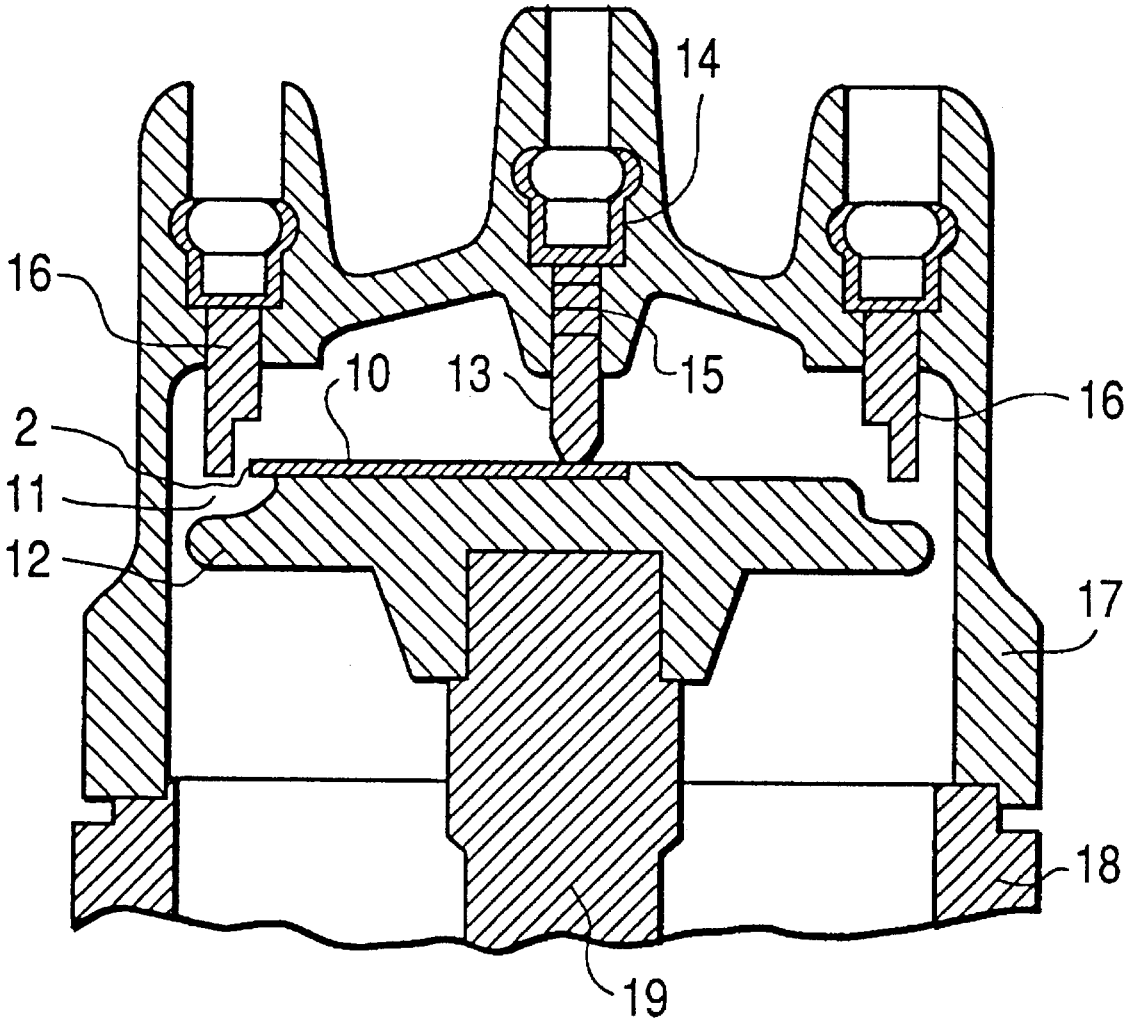
FIG. 3 PRIOR ART
FIG. 3 is a sectional view of a conventional distributor, to which the present invention is applicable.

It is well known that the emission of radio frequency noise in distributors of the type described herein is caused by an impulse current flowing through a floating electrostatic capacity between the rotating electrode 10 and the stationary electrode 16 (FIG. 3) at the beginning of the spark. That is, it is caused by a capacitive discharge current. In order to decrease such radio noise, the capacitive discharge current must be decreased. However, since the floating electrostatic capacity is determined by the shape of the distributor, it is impossible to decrease the capacitive discharge current drastically. Thus, it is more suitable to suppress radio frequency noise in such a distributor by lowering the voltage at the start of discharge.

It is known that the voltage at the start of discharge can be lowered substantially by adding dielectric materials to the sparking surface of the rotating electrode or the stationary electrode. For example, FIG. 2.*a* shows an arrangement using a rotating electrode 10B having a low discharge voltage characteristic, formed by a stainless steel plate 7, with an attached silicone resin plate 9. However, in such an arrangement, the reduction of the discharge voltage achieved by adding dielectric material can be dissipated over time due to the development of a gap 6 in the joint surface 8 between the stainless steel plate 7 and the silicone resin plate 9, caused in part by thermal distortion or melting when the rotating electrode is used for a long period.

Figure 2A:
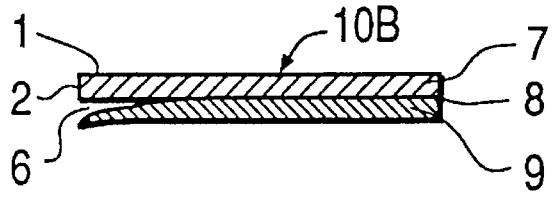
FIG. 2a PRIOR ART
FIG. 2.*a* is a sectional view of a rotating electrode showing the prior art.
Figure 2B:
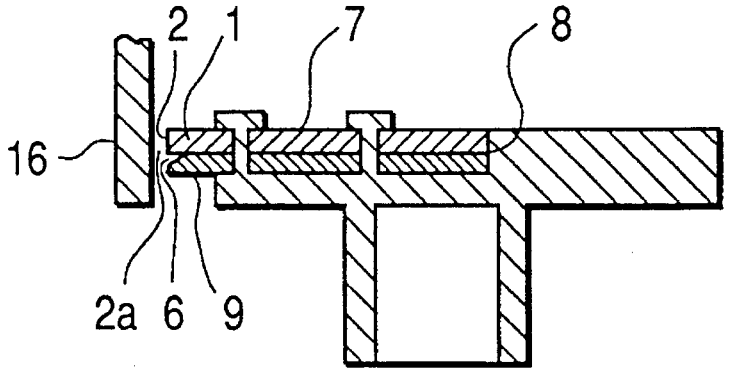
FIG. 2b PRIOR ART
Figure 2C:
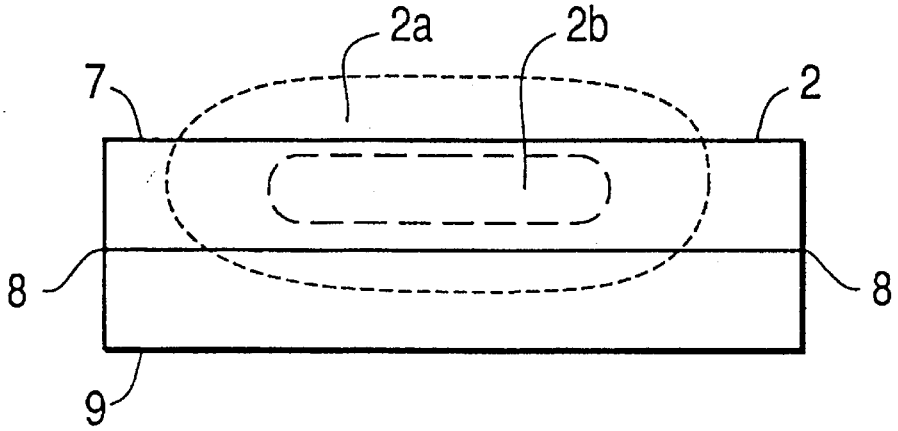

FIG. 2.*b* shows the rotating electrode of FIG. 2.*a* mounted on an insulator rotor with the sparking surface 2 of the steel plate 7 separated from the stationary electrode 16 by an air gap 2*c*. The deterioration of the resin plate 9 is again indicated at 6.

As shown in FIG. 2.*c*, thermal deformation or burning due to heat generated by the discharging arc occurs within a burn area 2*a* adjacent a discharge region (that is, the area within which the spark actually occurs) 2*b* of the sparking surface 2 on the metallic electrode 7. The heat generated in the discharge region 2*b* is sufficient that over an extended period of use, dielectric material situated in the adjacent burn area 2*a* will deteriorate, and a gap will develop, as shown in FIGS. 2.*a* and 2.*b*.

Figure 1A:
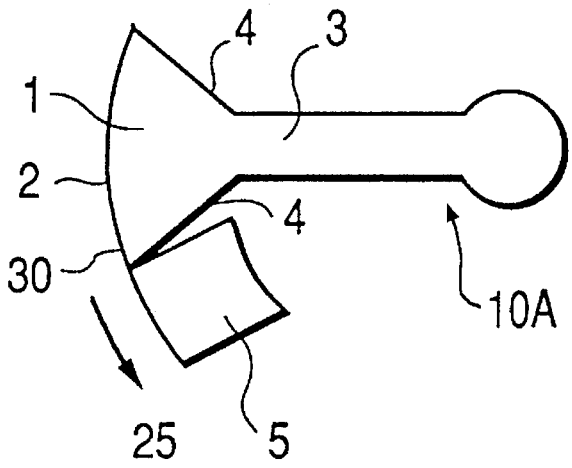
FIG. 1.*a* is a plan view of a first embodiment of a rotating electrode in a distributor in accordance with the present invention.
Figure 1B:
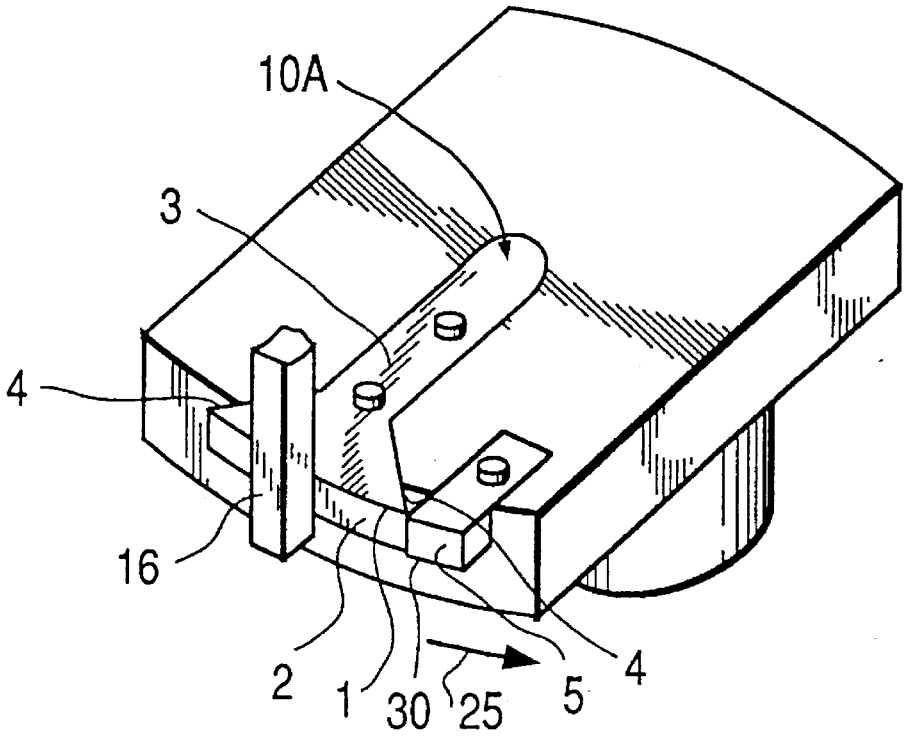

In the distributor according to the present invention, as shown in FIGS. 1.*a* and 1.*b*, a rotating electrode 10A is formed of metallic member 3, and a dielectric member 5 is mounted on the distributor rotor arm adjacent to the rotating electrode 10A at a side surface 4 thereof, forming a peripheral extension of the sparking surface 2. The dielectric member 5 contacts the rotating electrode 10A along a line perpendicular to the plane of the drawing in FIG. 1.*a* at point 30, as best seen in the perspective view in FIG. 1.*b*. This arrangement decreases the ignition voltage at the start of discharge due to the addition of the dielectric member 5, and radio noise is thus substantially decreased. Further, since as noted previously the thermal distortion (or burning) by the heat of the discharge arc takes place mainly at the central portion (relative to the rotating direction) of the sparking surface 2 in the metallic member 3 and in the adjacent burn area, thermal distortion or burning of the dielectric member 5 positioned on the side surface 4 in the metallic member 3 is greatly reduced. Thus, the rate of failure of the contact between the metallic member 3 and the dielectric member 5 caused by the heat of the discharge arc and the discharge voltage is reduced correspondingly, even during use over a long period.

The present invention is effective when the rotating electrode is energized by a negative potential. Also, although the dielectric member in the example of FIGS. 1.*a* and 1.*b* is shown attached on the leading edge of the electrode side surface 4, (relative to the direction of rotation), the same effect can be obtained when the dielectric member is attached on the opposite (trailing) surface.

FIGS. 4.*a*–4.*c* show another embodiment of the present invention, in which a brass plate 21 with a thickness of 2.5 mm is used as a main body of a rotating electrode 10C. Arcuate ferrite members 20, having a dielectric constant of 12, a thickness of 10 mm, a width of 10 mm and a length of 10 mm, are provided adjacent to and in line contact with the rotating electrode through a very small area at the side surfaces 4 of the rotating electrode 10C, and form extensions of the arcuate sparking surface 2 along the periphery of the circle having its center at the rotating shaft of the rotating electrode 10C (rotating body).

Figure 4A:
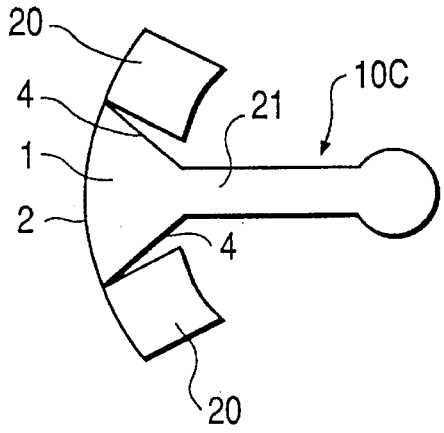
FIG. 4.*a* is a plan view of another embodiment of a rotating electrode in accordance with the present invention.
Figure 4B:
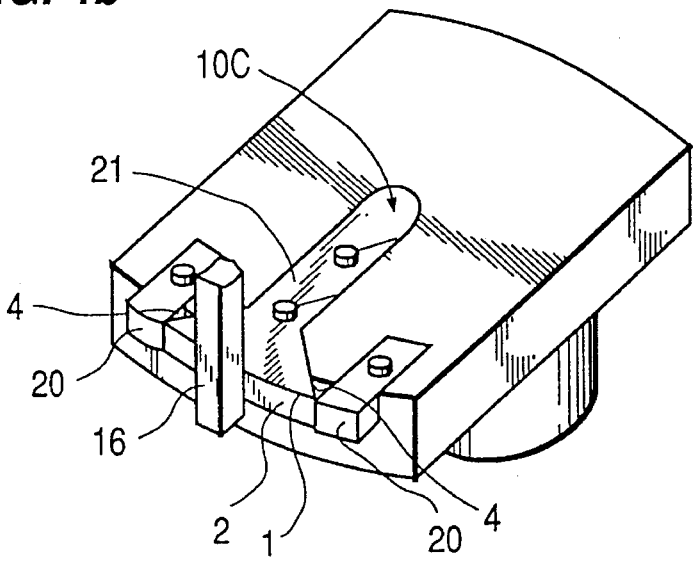
Figure 4C:
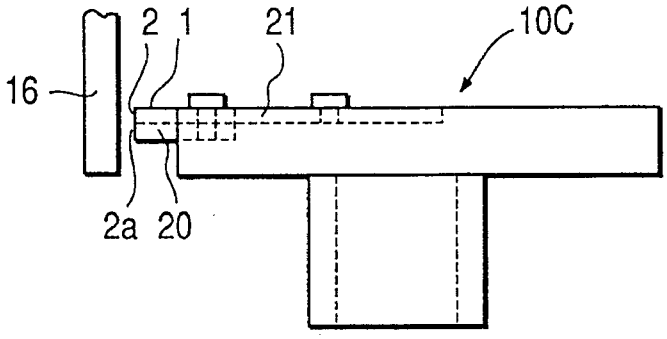
Figure 4D:
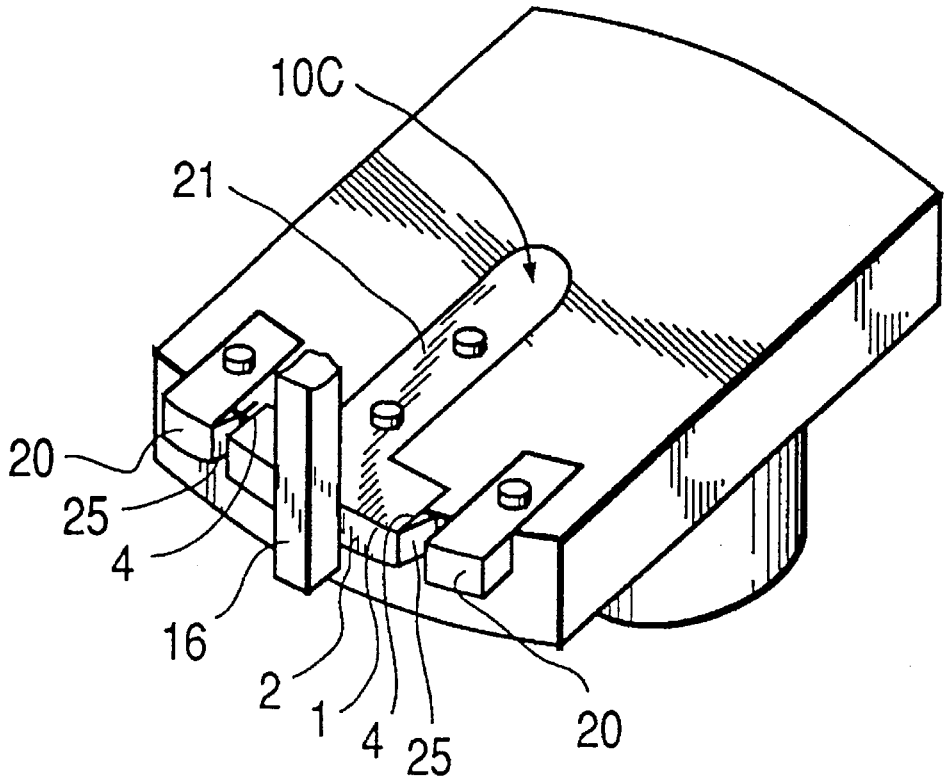
Figure 4E:
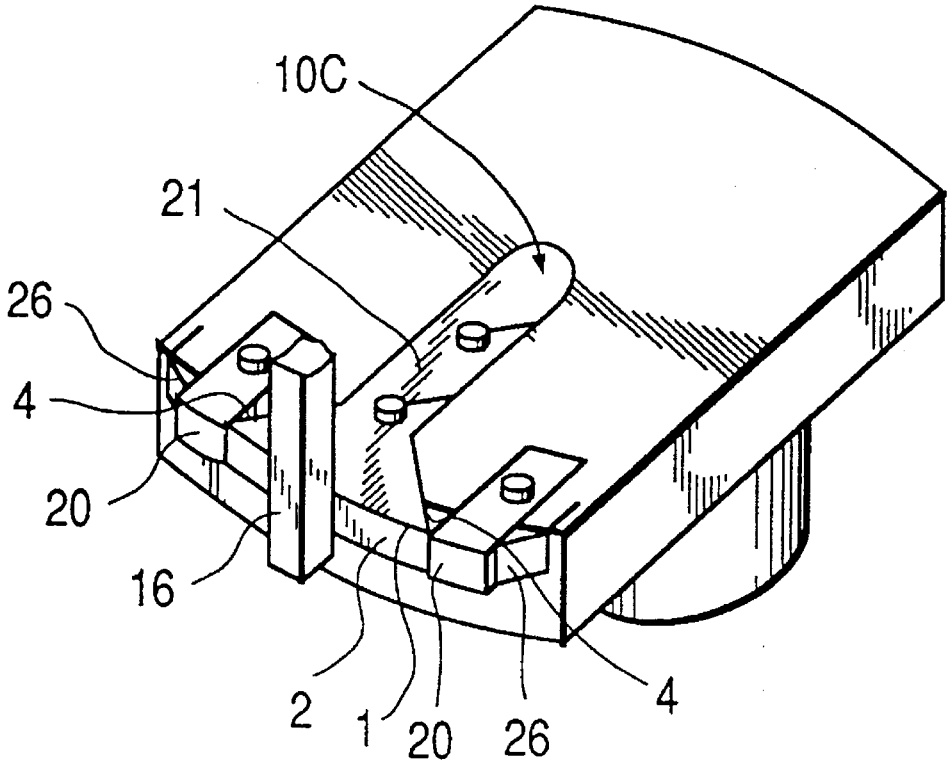
Figure 5:
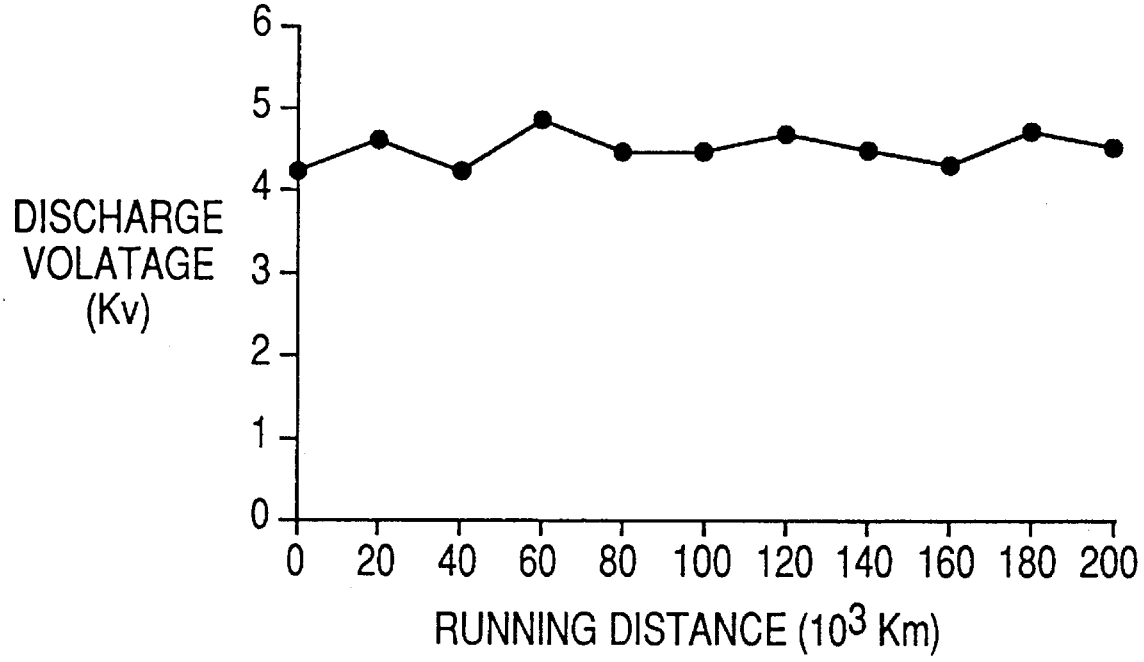
FIG. 5 is a graph showing a characteristic of the discharge voltage for the embodiment of FIG. 4.*a*–4.*c;*

FIG. 5 shows the discharge voltage obtained through a 200,000 kilometer test run of a vehicle with an engine having a distributor with the rotating electrode 10C as depicted in FIGS. 4*a*–*c* (The running distance is shown on the abscissa and the discharge voltage on the ordinate.) According to the result, the discharge voltage is substantially suppressed to a low level between 4.2 kV and 4.8 kV, which indicates good suppression of radio noise. Moreover, the discharge voltage increases very little with increasing distance, which indicates a good capacity to maintain effective suppression of radio noise for an extended use.

It should be noted that the ferrite member 20 in FIGS. 4*a*–*c* may also be provided at either of the side surfaces 4 in the rotating electrode 10C, as shown in FIG. 1. Furthermore, the position of the ferrite members 20 is not limited to the side surface 4. That is, alternatively, the ferrite may be provided in point contact (fine circle contact) or in line contact relationship (fine partial line contact) with the rotating electrode, behind the sparking surface 2 in the rotating electrode 10C. In this arrangement, a projection may be provided on the rotating electrode 10C to contact with the ferrite through the projection, or alternatively the projection may be provided on the ferrite member 20 instead of on the rotating electrode 10C. As further alternatives, the ferrite 20 may contact the rotating electrode 10C through an electrically conductive spring 25 or be pressed into contact with the rotating electrode by a spring 26, as shown in FIGS. 4.*d* and 4.*e* respectively.

The rotating electrode 10C may have a thickness of between 0.4 and 4.0 mm, and the dielectric member 5 (FIG. 1.*a*) added to the rotating electrode 10C may be a coated member (a member coated with a dielectric material) having a volume of at least 1.0 $mm^3$. Furthermore, the material of the dielectric member is not limited to ferrite; rather any material having a dielectric constant larger than 8.5 may be used, such as titanium oxide, alumina, tantalum oxide, barium titanate or zirconium lead titanate. Finally, although the main body of the rotating electrode 10C and a sparking point portion 1 are shown formed as a unit using a brass plate 2, the same effect can be achieved when a resistive or inductive member is used to connect them.

Figure 6A:
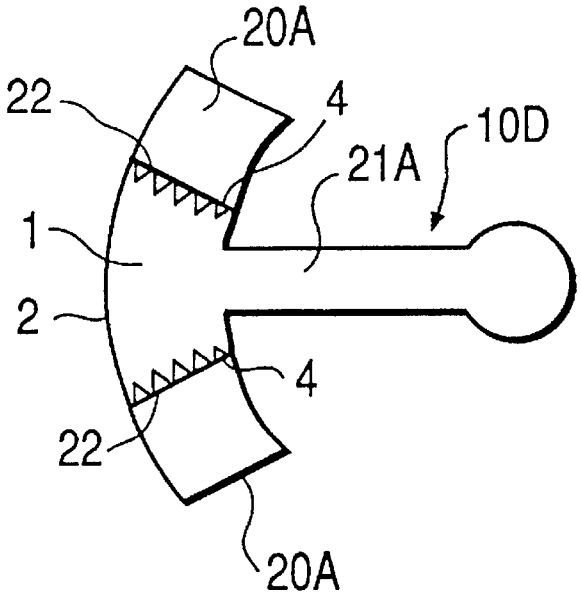
FIGS. 6.*a* and 6.*c* are plan views of a rotating electrode in still other embodiments of the present invention.
Figure 6B:
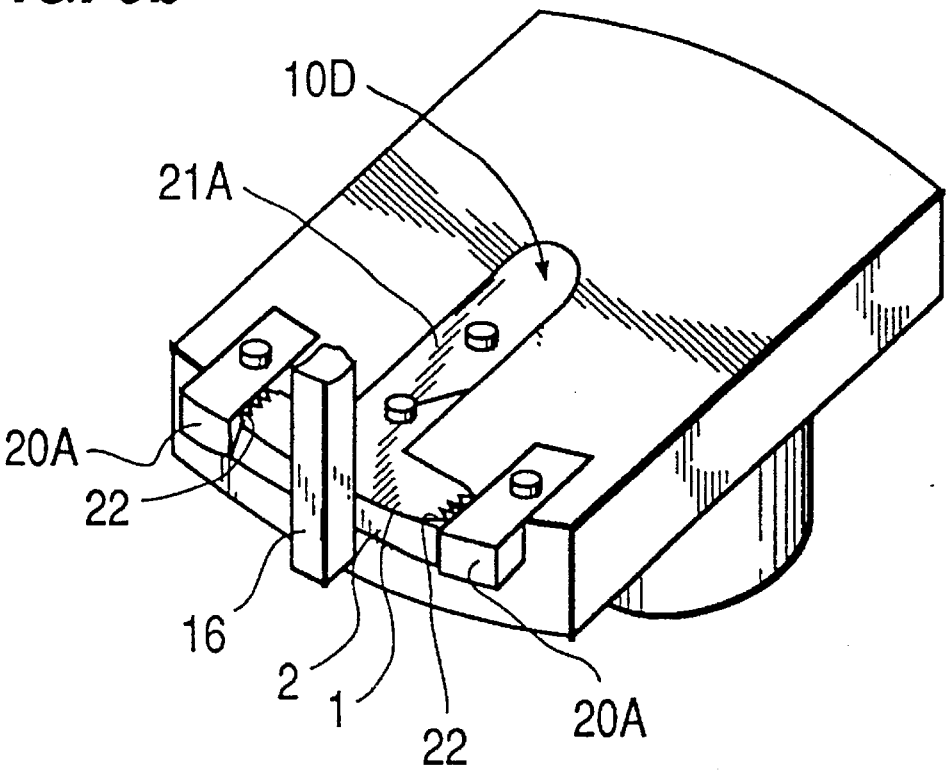

FIGS. 6.*a* and 6.*b* show another embodiment of the present invention, in which the rotating electrode 10D is made from a brass plate 21A (thickness 1.5 mm), and has a plurality of triangular projections 22 on the side surfaces 4 thereof. The triangular projections, which have a depth of 1.5 mm and a width of 1.5 mm throughout, make contact with the arcuate ferrite members 20A, which have a dielectric constant of 12, a thickness of 10 mm, a width of 10 mm and a length of 10 mm. The ferrite members 20A are in electrical contact with the rotating electrode.

Figure 7:
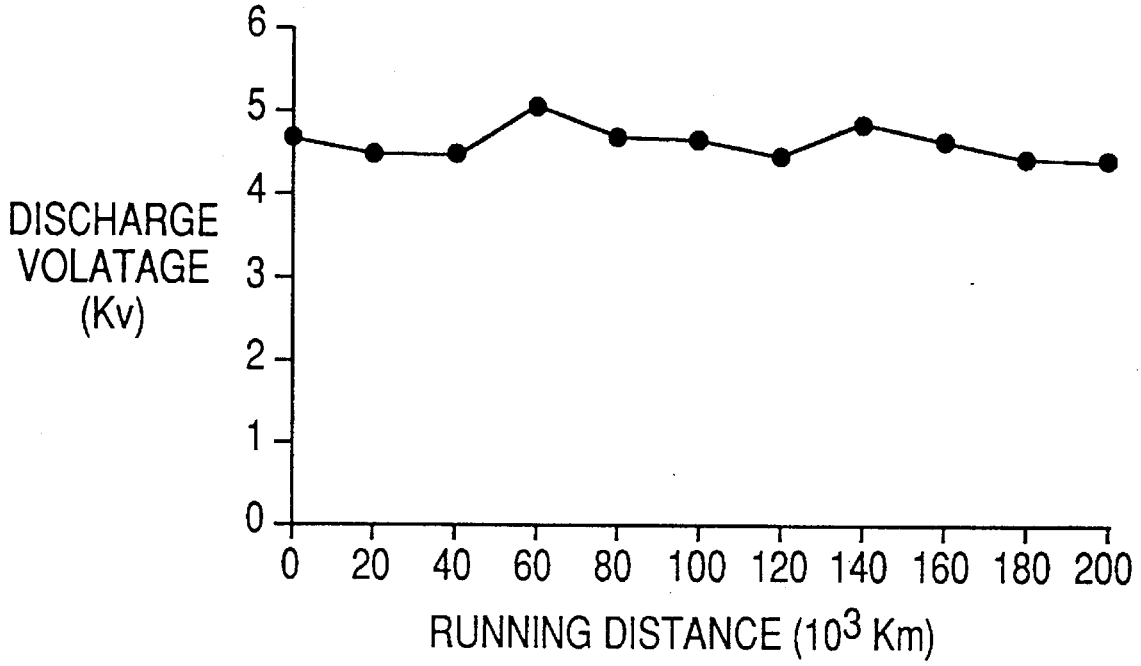
FIG. 7 is a graph showing the discharge voltage for the embodiment of FIG. 6.*a*–6.*b;*

FIG. 7 is a graph which shows the discharge voltage obtained through a 200,000 kilometer running test with a vehicle using an engine having a distributor with the rotating electrode 10D, as shown in FIGS. 6.*a* and 6.*b*. According to FIG. 7, the discharge voltage is substantially suppressed to between 4.4 kV and 5.0 kV. Furthermore, as the running distance increases, the discharge voltage increases very little, indicating that this arrangement is capable of maintaining favorable radio noise suppression during prolonged use.

Figure 6C:
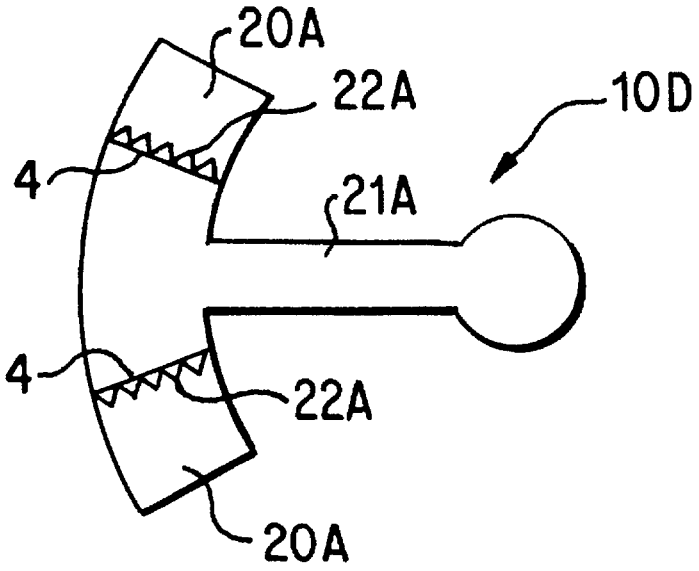

In this embodiment, the ferrite members 20A may be provided at either of the side surfaces 4 in the rotating electrode 10D. The ferrite may also be provided in contact relationship with the rotating electrode behind the sparking surface 2 in the rotating electrode 10D. It may also be provided with a plurality of triangle projections 22A as shown in FIG. 6c. Further, as with the embodiment in FIG. 4.*e*, the ferrite may be pressed into contact with the rotating electrode 10D by a spring.

The rotating electrode 10D in the embodiment of FIG. 6.*a* and 6.*b* may have a thickness within the range 0.4~4.0 mm, and the dielectric member 20A may be a compact member or a coated member having a volume larger than 10 $mm^3$. As in the previous embodiments, the material of the dielectric member is not limited to ferrite; it may be any material having a dielectric constant larger than 8.5, such as titanium oxide, alumina, tantalum oxide, barium titanate or zirconium lead titanate. Moreover, although the main body of the rotating electrode 10D and the sparking portion 1 are depicted as a unit using a brass plate 2, the same effect can be achieved when they are made as separate elements, and a resistive or inductive element is used to connect them.

Figure 8A:
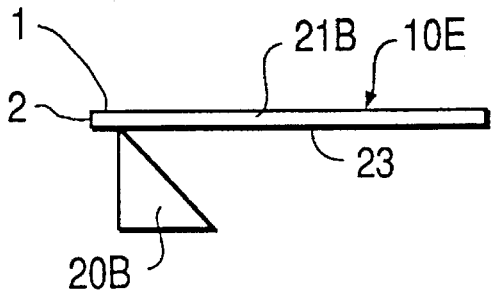
FIG. 8A and 8B are side views of a rotating electrode in yet other embodiments of the present invention.

FIG. 8A shows still another embodiment of the present invention, in which a brass plate 21B having a thickness of 1.5 mm is used as a rotating electrode 10E. In this embodiment, a dielectric member comprises an isosceles triangular shaped ferrite member 20B having a dielectric constant of 12. The triangular dielectric member has a base of 10 mm and a height of 10 mm, and is arranged in line contact with the rotating electrode 1 on the underneath side thereof.

Figure 8B:
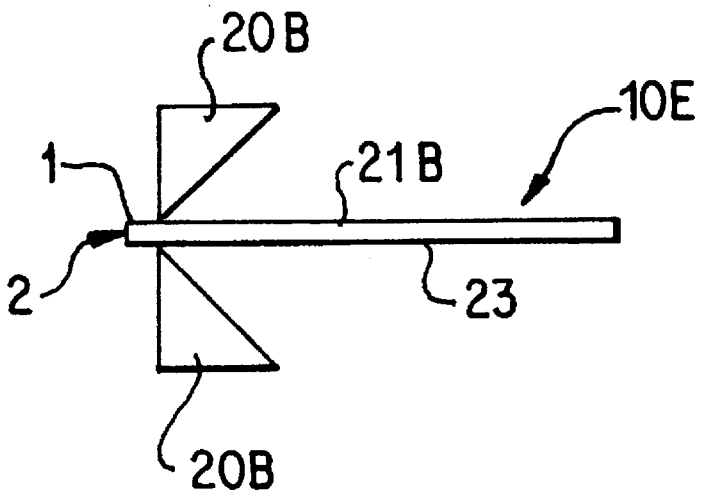

FIG. 8B shows another embodiment in which ferrite members 20B are provided on both the top and bottom surfaces of the rotating electrode 1.

Figure 9:
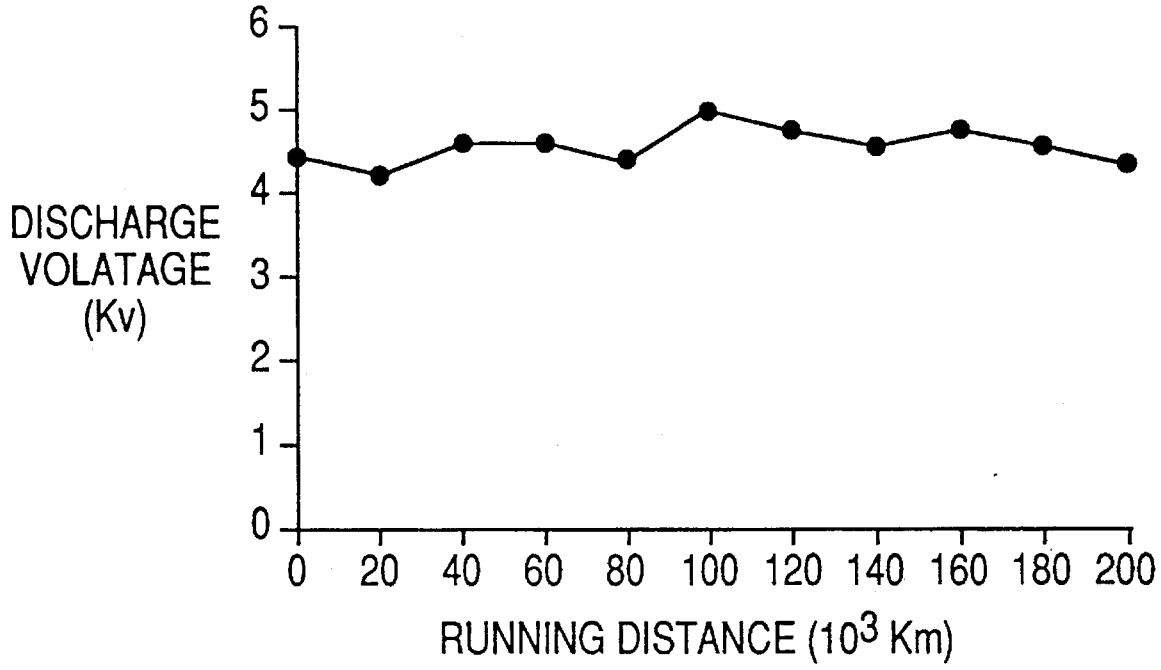
FIG. 9 is a graph showing the discharge voltage for the embodiment of FIG. 8.

FIG. 9 is a graphic presentation of the discharge voltage generated in a 200,000 kilometer running test of a vehicle using an engine having a distributor with the rotating electrode 10E, as shown in FIG. 8. This graph shows that the discharge voltage is substantially suppressed to between 4.4 kV and 4.8 kV, and increases very little when the running distance increases. Thus, like the others, this embodiment maintains a good radio noise suppression during long use.

The ferrite 20B in FIG. 8 may also be provided at both the top and the bottom of the rotating electrode 10E, or behind the sparking surface, to obtain the same effect. Furthermore, it may be pressed into contact with the rotating electrode 10E by a spring.

The rotating electrode 10E may have a thickness within the range 0.4~4.0 mm, and the dielectric member 5 may be a compact member or a coated member having a volume larger than 10 $mm^3$. The material from which the dielectric member is made is not limited to ferrite, but may be any material having a dielectric constant larger than 8.5, such as titanium oxide, alumina, tantalum oxide, barium titanate or zirconium lead titanate.

Finally, although the main body of the rotating electrode 10E and a sparking point portion 1 are formed as a unit from a brass plate 21B, the same effect can be achieved when a resistive or inductive element is used to connect them instead, as noted previously.

Figure 10A:
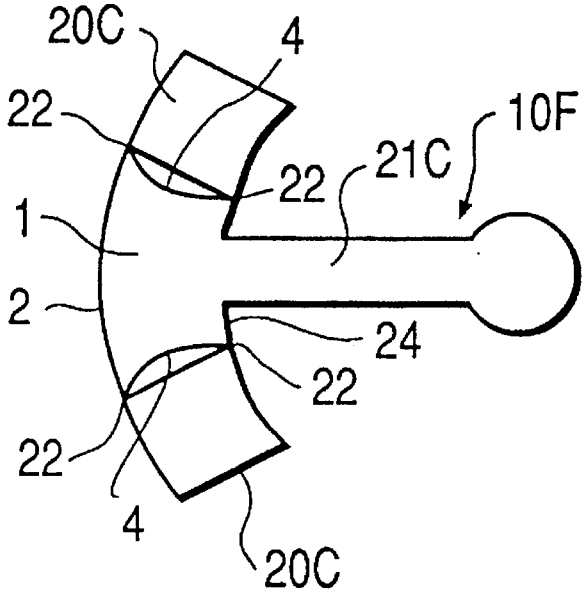
FIG. 10.*a* is a plan view of a rotating electrode of a further embodiment of the present invention.
Figure 10B:
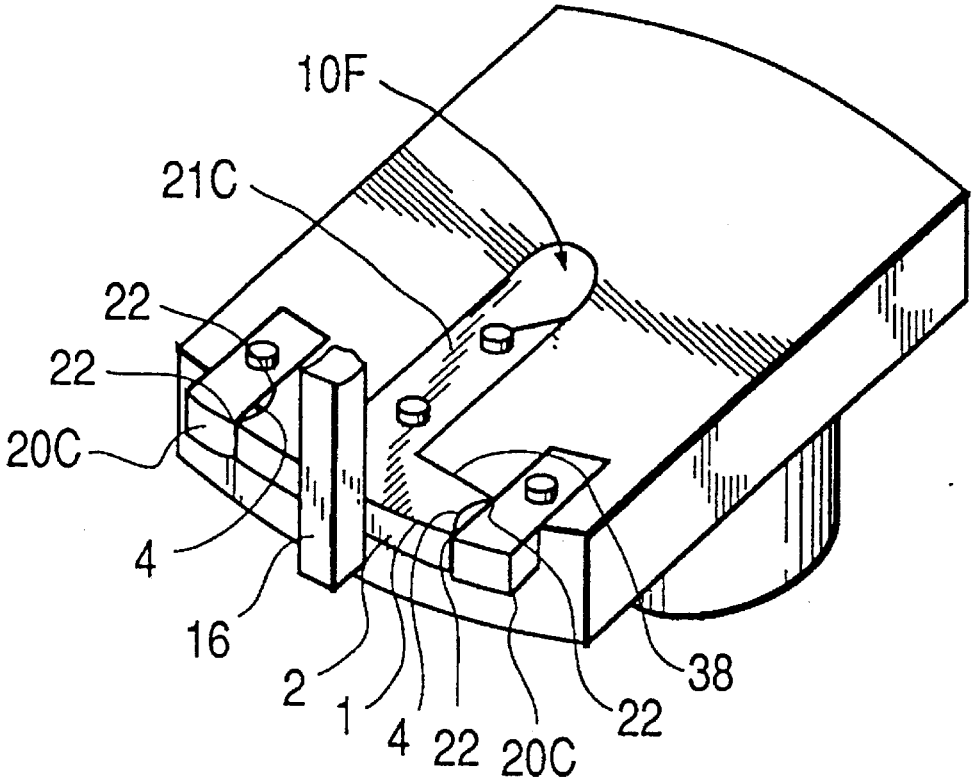
Figure 10C:
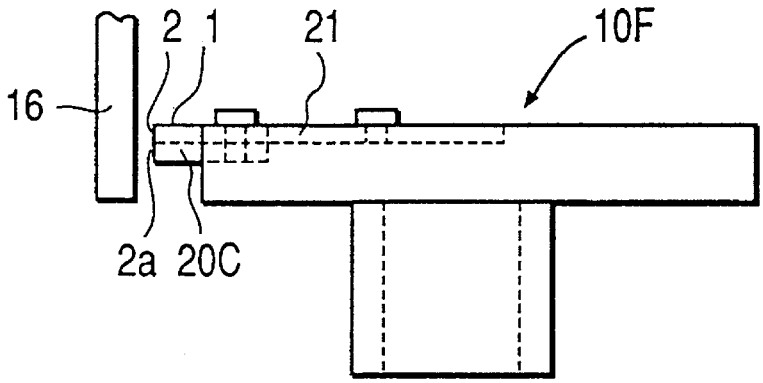

Next, FIGS. 10.*a*–10.*c* show a further embodiment of the present invention. In this embodiment, the rotating electrode 10F is made from a brass plate 21C having a thickness of 1.5 mm. The side surfaces 4 of the rotating electrode 10F are curved, so as to provide line contact 22 with the ferrite member 20C at both the front (sparking surface) and rear (opposite the sparking surface) of the rotating electrode 10F. Arcuate dielectric members 20C, having a dielectric constant of 12, a thickness of 10 mm, a width of 10 mm, and a length of 10 mm are provided in contact relationship with the rotating electrode.

Figure 11:
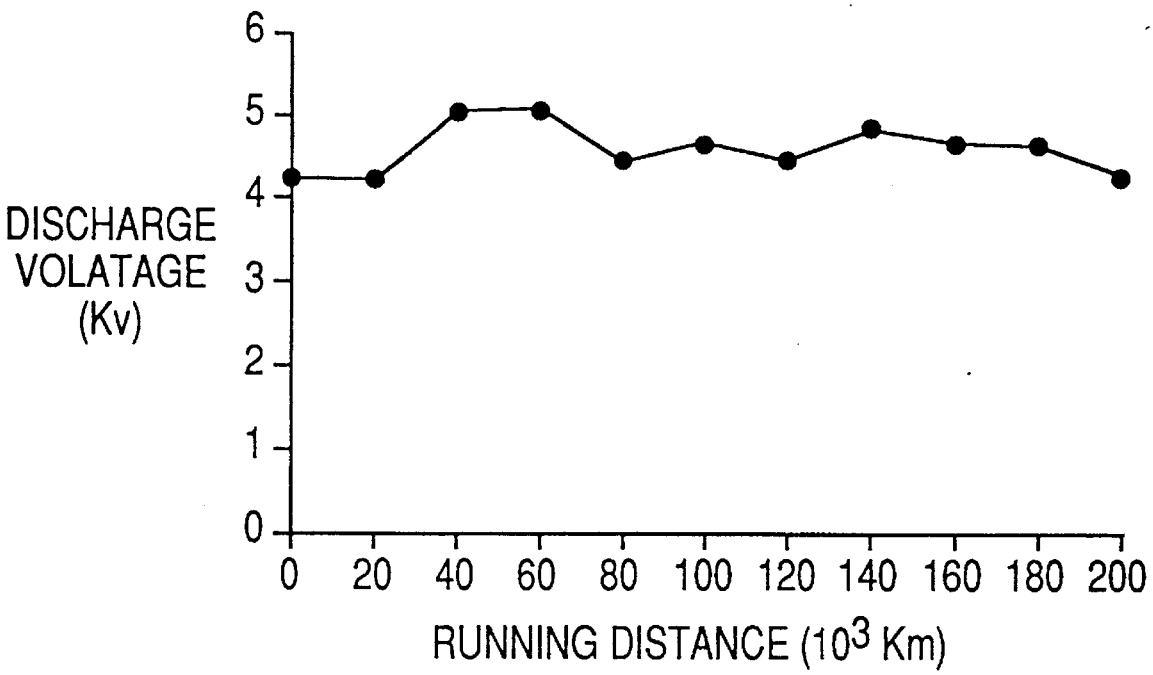
FIG. 11 is a graph showing the discharge voltage for the embodiment of FIG. 10.*a*–10.*c;*

FIG. 11 shows the discharge voltage generated through a 200,000 kilometer running test of a vehicle using an engine having a distributor with the rotating electrode 10F. As can be seen, the discharge voltage is substantially suppressed to a low level between 4.2 kV and 5.0 kV, and increases very little as the running distance increases. Thus, this embodiment is also capable of maintaining good suppression of radio noise during long use.

The dielectric member 20C in FIGS. 10.*a*–*c* may also be positioned at either side 4 of the rotating electrode 10F, or alternatively, it may be provided in contact relationship with the rotating electrode 10F at two portions behind the sparking surface 2 in the rotating electrode 10F provided projections 22. Furthermore, the projection 22 may be provided on the dielectric 20C instead of the rotating electrode 10F. The dielectric members 20C may contact the rotating electrode 10F through an electrically conductive spring, or may be pressed into contact with the rotating electrode 10F by a spring.

The rotating electrode 10F may have a thickness within a range of 0.4~4.0 mm, and the dielectric member added to the rotating electrode 10F may be a compact member or a coated member having a volume larger than 10 $mm^3$. The dielectric member may be made from ferrite or from any other material having dielectric constant larger than 8.5, such as titanium oxide, alumina, tantalum oxide, barium titanate or zirconium lead titanate. Although the main body of the rotating electrode 10F and sparking point portion 1 are formed as a unit from a brass plate 21C, the same effect can be achieved when a resistive or inductive element is used to connect them instead.

Figure 12:
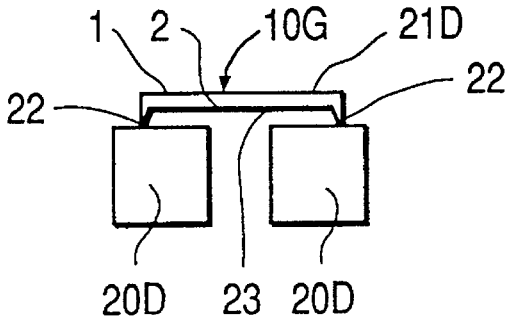
FIG. 12 is a front view of a rotating electrode of another embodiment of the present invention.

FIG. 12 shows still another embodiment of the present invention in which the rotating electrode 10G is made from a brass plate 21D having a thickness of 1.5 mm, and has projections 22 at both ends (in the peripheral direction) of its bottom surface 23. Arcuate ferrite members 20D having dielectric constant of 12, a thickness of 10 mm, a width of 10 mm and a length of 10 mm are provided in contact relationship with the rotating electrode.

Figure 13:
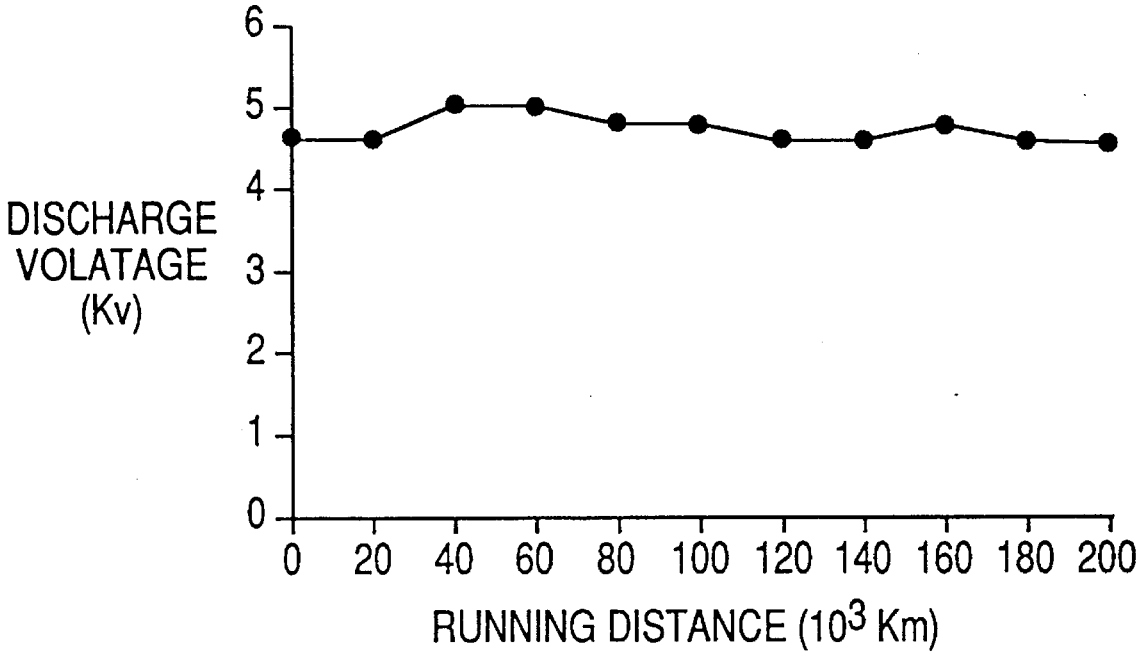
FIG. 13 is a graph showing the discharge voltage of the embodiment of FIG. 12.

FIG. 13 shows the discharge voltage generated through a 200,000 kilometer running test of a vehicle using an engine having a distributor with the rotating electrode 10G shown in FIG. 12. It demonstrates that the discharge voltage is substantially suppressed to a level between 4.6 kV and 5.0 kV. Moreover, with increasing running distance, the discharge voltage increases very little, which indicates that this embodiment can maintain good suppression of radio noise during long use.

In this embodiment, a ferrite member 20D may also be provided at either end of the bottom surface 23 (in the peripheral direction) of the rotating electrode 10G, and the projections 22 may be provided on the ferrite members 20D instead of on the rotating electrode 10G. Moreover, the ferrite members 20D may make contact with the rotating electrode 10G through an electrically conductive spring, or may be pressed into contact with the rotating electrode 10G by a spring. The rotating electrode 10G may have a thickness within the range of 0.4~4.0 mm, and the dielectric member added to the rotating electrode 10G may be a compact member or a coated member having a volume larger than 10 $mm^3$. The dielectric members may be made of ferrite, or of any other material having dielectric constant larger than 8.5, such as titanium oxide, alumina, tantalum oxide, barium titanate or zirconium lead titanate. Although the main body of the rotating electrode 10D and a sparking point portion 1 are formed as a unit in this embodiment using a brass plate 21D, the same effect can be achieved by using a resistive or inductive element to connect them instead.

Figure 14A:
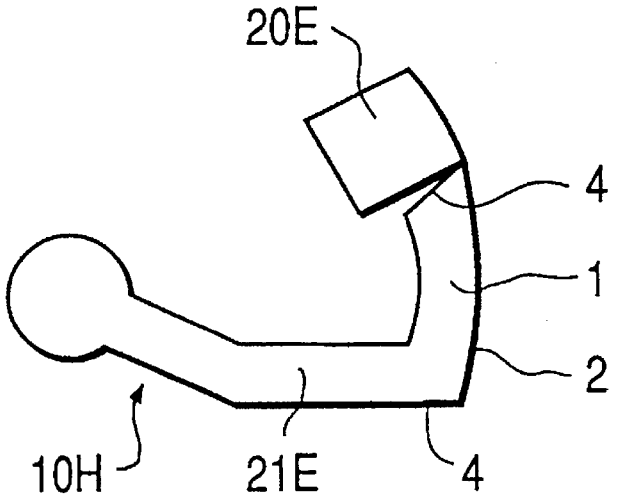
FIG. 14.*a* is a plan view of a rotating electrode of another embodiment of the present invention.
Figure 14B:
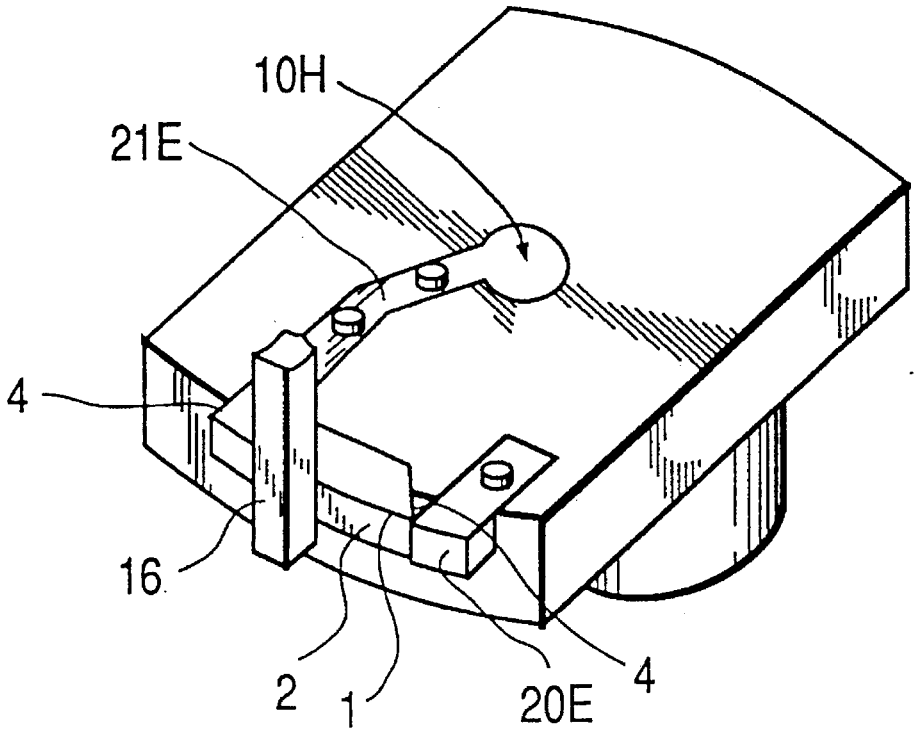

FIGS. 14*a–b* show yet another embodiment of the present invention. A brass plate 21E having a thickness of 1.5 mm is used as a main body of a rotating electrode 10H, which as a sparking point portion 1 that is canted toward one side thereof. Arcuate ferrite member 20E having a dielectric constant of 12, a thickness of 10 mm, a width of 10 mm and a length of 10 mm is arranged in contact with the rotating electrode 10H at a side surface 4 thereof, forming a peripheral extension of the sparking surface 2.

Figure 15:
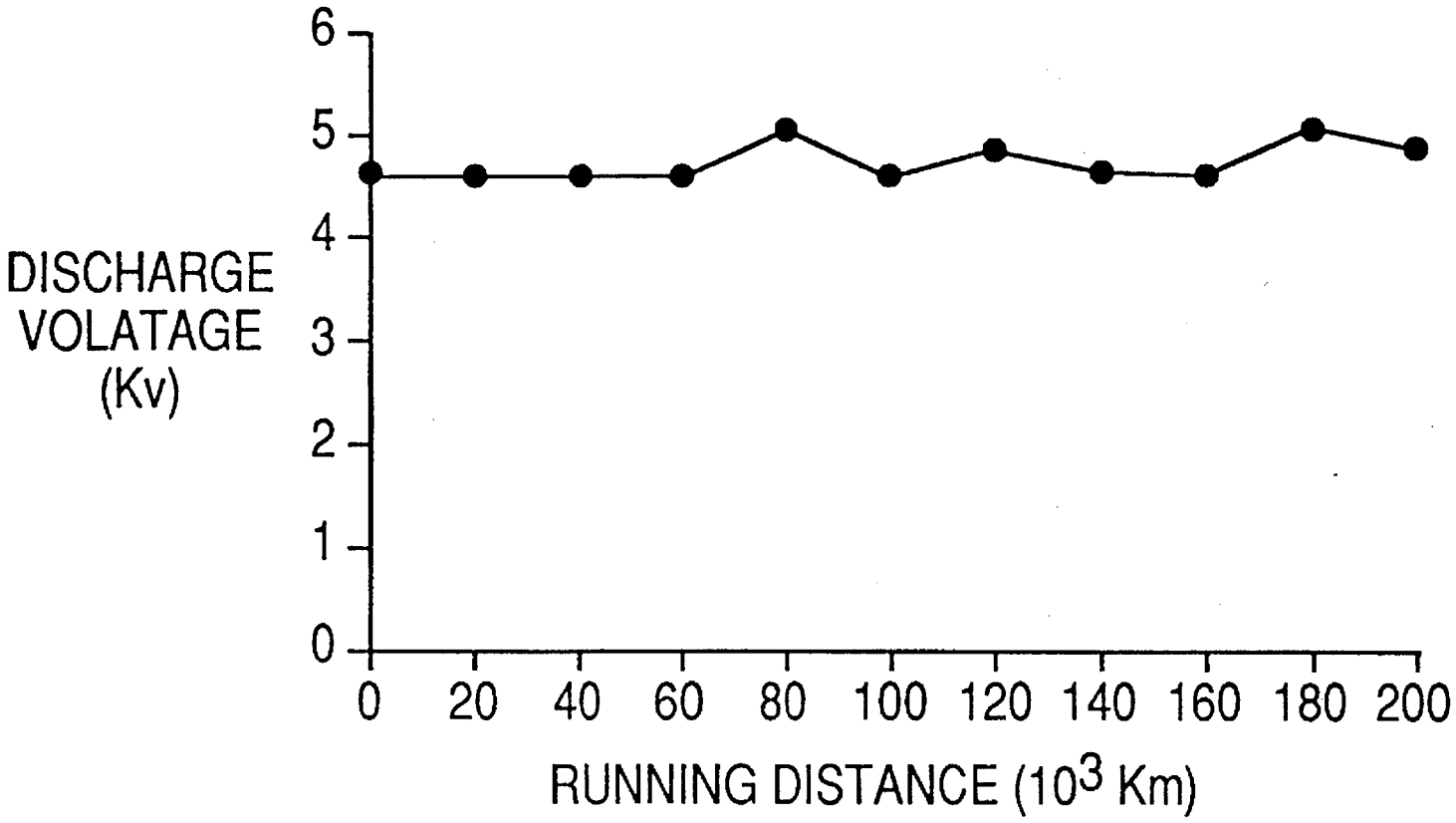
FIG. 15 is a graph showing a characteristic of the discharge voltage for the embodiment of FIG. 15.

FIG. 15 is a graphic presentation of the discharge voltage generated through a 200,000 kilometer running test of a vehicle using an engine having a distributor with the rotating electrode 10H as shown in FIG. 14. For this embodiment, the discharge voltage is substantially suppressed to between 4.6 kV and 5.0 kV, and increases very little when the running distance increases, indicating that it is capable of maintaining good suppression of radio noise, for a long use.

In this embodiment, projections may also be provided on the ferrite 20E as well as on the rotating electrode 10H. Further, the ferrite 20E may contact the rotating electrode 10H through an electrically conductive spring, or may be pressed into contact with it by a spring. The rotating electrode 10H itself may have a thickness of from 0.4 to 4.0 mm, and the dielectric member may be a compact member or a coated member having a volume larger than 10 $mm^3$. The material of the dielectric member is not limited to ferrite 20E, but may be any material having a dielectric constant larger than 8.5, such as titanium oxide, alumina, tantalum oxide, barium titanate or zirconium lead titanate.

Although the main body of the rotating electrode 10H and the sparking point portion 1 are formed as a unit using a brass plate 21E, in this embodiment, the same effect can be achieved by connecting them with a resistive or inductive element.

According the present invention, the increase of the discharge voltage caused by the discharge arc can be kept extremely low, and the radio noise generated from a distributor can effectively be suppressed for a long period.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. Electrode arrangement for a rotor in a distributor of an internal combustion engine of the type having a rotating electrode and a stationary electrode for supplying a high voltage to a discharge region of a sparking surface of said rotating electrode, at an outer periphery of said rotating electrode, when said discharge region is rotationally adjacent said stationary electrode, said electrode arrangement comprising:

a rotating electrode made of an electrically conductive material and mounted on said rotor; and at least one dielectric element mounted on said rotor; wherein;

said at least one dielectric element is in electrical contact with said rotating electrode, and is mounted on said rotor adjacent said outer periphery of said rotating electrode, at a location which is angularly removed from said discharge region relative to a direction of rotation of said rotor, whereby said at least one dielectric element is not rotationally adjacent said stationary electrode when said discharge region is rotationally adjacent said stationary electrode and said stationary electrode delivers said high voltage to said discharge region.

2. Electrode arrangement according to claim 1 wherein said at least one dielectric element is in line contact with said rotating electrode.

3. Electrode arrangement according to claim 2 wherein said rotating electrode and said at least one dielectric element are held in electrical contact by a spring element.

4. Electrode arrangement according to claim 2 wherein:

said at least one dielectric element is mounted on said rotor adjacent a lateral surface of said rotating electrode which lateral surface intersects said sparking surface, and said dielectric element forms a peripheral extension of said sparking surface in a direction parallel to a direction of rotation of said rotor.

5. Electrode arrangement according to claim 1 wherein said at least one dielectric element is in point contact with said rotating electrode.

6. Electrode arrangement according to claim 1 wherein said electrical contact comprises an electrically conductive spring connected between said rotating electrode and said at least one dielectric element.

7. Electrode arrangement according to claim 1 wherein said rotating electrode and said at least one dielectric element are held in electrical contact by a spring element.

8. Electrode arrangement according to claim 1 wherein said rotating electrode has a burn area in said sparking surface adjacent said discharge region; and said at least one dielectric element contacts said rotating electrode only outside said burn area.

9. Electrode arrangement according to claim 8 wherein a locus of contact between said rotating electrode and said at least one dielectric element is defined by a line.

10. Electrode arrangement according to claim 8 wherein a locus of contact between said rotating electrode and said at least one dielectric element is defined by a point.

11. Electrode arrangement according to claim 8 wherein:

said at least one dielectric element is mounted on said rotor adjacent a lateral surface of said rotating electrode which lateral surface intersects said sparking surface, and said dielectric forms a peripheral extension of said sparking surface in a direction parallel to a direction of rotation of said rotor.

12. Electrode arrangement according to claim 11 wherein said side surface of said rotating electrode has a concave curvature, and wherein said at least one dielectric member makes line contact with said side surface at extremities of said concave curvature adjacent said sparking surface and remote therefrom.

13. Electrode arrangement according to claim 8 wherein said rotating electrode has at least one side surface with a plurality of triangular projections, which side surface intersects with said sparking surface, and said at least one dielectric element is in contact with said projections.

14. Electrode arrangement according to claim 8 wherein said at least one dielectric element has a plurality of triangular projections which are in electrical contact with a side surface of said rotating electrode.

15. Electrode arrangement according to claim 8 comprising two dielectric members, wherein:

said rotating electrode has concave arcuate side surfaces adjacent leading and trailing edges of said sparking surface relative to a direction of rotation of said rotor; and wherein said two dielectric members are mounted adjacent said side surfaces and make line contact with said side surfaces at extremities thereof, adjacent said sparking surface and remote therefrom.

16. Electrode arrangement according to claim 1 wherein:

said at least one dielectric element is mounted on said rotor adjacent a lateral surface of said rotating electrode which lateral surface intersects said sparking surface, and said dielectric element forms a peripheral extension of said sparking surface in a direction parallel to a direction of rotation of said rotor.

17. Electrode arrangement according to claim 16 wherein said at least one dielectric element extends from a leading edge of said sparking surface relative to a direction of rotation of said rotor.

18. Electrode arrangement according to claim 16 wherein said at least one dielectric element extends from a trailing edge of said sparking surface relative to a direction of rotation of said rotor.

19. Electrode arrangement according to claim 16 comprising two dielectric elements mounted adjacent to, and extending peripherally from, leading and trailing edges, respectively, of said sparking surface of said rotating electrode.

20. Electrode arrangement according to claim 16 wherein said side surface has a plurality of triangular projections and said at least one dielectric element is in contact with said projections.

21. Electrode arrangement according to claim 16 wherein said at least one dielectric element has a plurality of triangular projections which are in electrical contact with said side surface of said rotating electrode.

22. Electrode arrangement according to claim 16 wherein said side surface of said rotating electrode has a concave curvature, and wherein said at least one dielectric member makes line contact with said side surface at extremities of said concave curvature adjacent said sparking surface and remote therefrom.

23. Electrode arrangement according to claim 1 wherein said rotating electrode has at least one side surface with a plurality of triangular projections, which side surface intersects with said sparking surface, and said at least one dielectric element is in contact with said projections.

24. Electrode arrangement according to claim 23 comprising two dielectric elements which are mounted in contact with triangular projections from respective leading and trailing side surfaces of said rotating electrode relative to a direction of rotation of said rotor.

25. Electrode arrangement according to claim 1 wherein said at least one dielectric element has a plurality of triangular projections which are in electrical contact with a side surface of said rotating electrode.

26. Electrode arrangement according to claim 1 comprising two dielectric members, wherein:

said rotating electrode has concave arcuate side surfaces adjacent leading and trailing edges of said sparking surface relative to a direction of rotation of said rotor; and wherein said two dielectric members are mounted adjacent said side surfaces and make line contact with said side surfaces at extremities thereof, adjacent said sparking surface and remote therefrom.

27. Electrode arrangement according to claim 1 wherein each of said at least one dielectric element is mounted in point contact with one of a top surface and a bottom surface of said rotating electrode.

28. Electrode arrangement according to claim 27 wherein said point contact is situated adjacent one of a leading and a trailing edge, relative to a direction of rotation of said rotor, of said sparking surface.

29. Electrode arrangement according to claim 27 comprising two dielectric elements which are situated adjacent with leading and trailing edges, respectively, of a sparking surface of said rotating electrode.

30. Electrode arrangement according to claim 1 wherein:

said electrode comprises an elongated brass plate which extends radially outward from a center of rotation of said rotor; and wherein said elongated brass plate is inclined in a plane of rotation of said rotor in one of a leading and a trailing direction thereof relative to a direction of rotation of said rotor.

31. Electrode arrangement according to claim 30 wherein said at least one dielectric element is mounted adjacent a side surface of said rotating electrode, which side surface intersects said sparking surface, and forms a peripheral extension of said sparking surface.

32. Electrode arrangement for a rotor in a distributor of an internal combustion engine of the type having a rotating electrode and a stationary electrode for supplying a high voltage to a discharge region of a sparking surface of said rotating electrode, at an outer periphery of said rotating electrode, when said discharge region is rotationally adjacent said stationary electrode, said electrode arrangement comprising:

a rotating electrode made of an electrically conductive material and mounted on said rotor; and at least one dielectric element mounted on said rotor adjacent a rotational extremity of said sparking surface, whereby said dielectric element is not continuously adjacent said fixed electrode when said rotating electrode is adjacent said fixed electrode; wherein:

said at least one dielectric element is in physical and electrical contact with said rotating electrode; and physical and electrical contact between said rotating electrode and said at least one dielectric element is confined to a locus defined by a line.

33. Electrode arrangement according to claim 32 wherein said at least one dielectric element is mounted in line contact with at least one of a bottom surface and a top surface of said rotating electrode.

34. Electrode arrangement according to claim 33 comprising two dielectric elements mounted in line contact with said top and bottom surfaces respectively.

35. Electrode arrangement according to claim 32 wherein:

said sparking surface includes a burn area adjacent said discharge region; and said line is situated outside said burn region.

36. Electrode arrangement according to claim 35 wherein said at least one dielectric element is mounted in line contact with at least one of a bottom surface and a top surface of said rotating electrode.

37. Electrode arrangement according to claim 32 wherein said line extends in a direction substantially parallel to a direction of rotation of said rotor.

* * * * *